United States Patent [19]

Woolley

[11] 3,935,714

[45] Feb. 3, 1976

[54] TEMPERATURE CONTROL SYSTEM OF A REFRIGERATOR-FREEZER

[75] Inventor: Samuel J. Woolley, Louisville, Ky.

[73] Assignee: General Electric Company, Louisville, Ky.

[22] Filed: Jan. 29, 1975

[21] Appl. No.: 545,010

[52] U.S. Cl. ..... 62/187; 62/265; 62/267

[51] Int. Cl.[2] ..... F25D 17/04

[58] Field of Search ..... 62/187, 265, 266, 267

[56] References Cited

UNITED STATES PATENTS

| | | | |
|---|---|---|---|
| 1,943,646 | 1/1934 | Warren | 62/266 |
| 2,098,724 | 11/1937 | Hokanson | 62/267 |
| 2,543,494 | 2/1951 | Hartman | 62/265 |
| 2,660,036 | 11/1953 | Moore | 62/265 |
| 3,048,985 | 8/1962 | Long | 62/187 |
| 3,084,520 | 4/1963 | Jacobs | 62/187 |
| 3,375,679 | 4/1968 | Helsel | 62/441 |

*Primary Examiner*—William J. Wye

[57] ABSTRACT

A household refrigerator-freezer has an air passageway formed through the partition between the freezer and the fresh food compartment. Air is controllably passed by convection through the passageway for maintaining the fresh food compartment in a preselected temperature range. Apparatus is associated with the passageway for controllably opening and closing the air passageway.

5 Claims, 4 Drawing Figures

TEMPERATURE CONTROL SYSTEM OF A REFRIGERATOR-FREEZER

BACKGROUND OF THE INVENTION

In the use of a refrigerator-freezer, particularly during periods of high ambient temperature, the fresh food compartment door is often opened to recover cold beverages and other items. Each time the door is opened, chilled air within the fresh food compartment passes through the door and warm air passes into the fresh food compartment. Under some warm weather conditions where the door is repeatedly opened, the refrigerating capacities during continuous operation are not sufficient to maintain the temperature of the fresh food compartment with a preselected temperature range of about 1° to about 9°C. However, since the door of the freezer compartment is less frequently opened, it has been discovered that additional cooling capacities reside in the freezing compartment of the refrigerator-freezer. The problem therefore resides in developing an apparatus which provides for controlled passage of chilled air by convection from the freezer compartment into the fresh food compartment, is responsive to the temperature of the fresh food compartment, and is responsive to opening and closing the refrigerator door.

Attempts have heretofore been made to provide additional chilled air to the fresh food compartment by providing a temperature responsive air control means in the air discharge conduit serving the fresh food compartment. An example apparatus is shown in U.S. Pat. No. 3,375,679-Helsel. However, this device is effective only during the operation of the refrigeration cooling system, does not provide for the passage of air by convection from the freezer compartment into the fresh food compartment, and does not function in response to opening and closing the fresh food compartment door.

The apparatus of this invention provides for chilled air to pass by convection from the freezer compartment into the fresh food compartment in response to opening the refrigerator door and additional chilled air to pass by convection into the fresh food compartment in response to the temperature of the fresh food compartment being at a temperature greater than a preselected value. By utilizing the apparatus of this invention, the temperature within the fresh food compartment is maintained at a desirable value for preserving food during hot weather conditions and repeated openings of the refrigerator door.

SUMMARY OF THE INVENTION

In accordance with this invention, a household refrigerator-freezer has a fresh food compartment, a freezer compartment, a partition separating the fresh food compartment from the freezer compartment, and a fresh food compartment access door. An air passageway having an inlet and an outlet extends through the partition for the passage of air from the freezer compartment into the fresh food compartment. A cover plate is pivotally connected to the partition. The cover plate is movable between a closed position at which the cover plate is covering the air passageway and an open position at which the cover plate is spaced from at least a portion of the air passageway outlet. The cover plate is biased to the open position in response to opening the door. A biasing means is provided for biasing the cover plate toward the closed position in response to closing the door. A temperature responsive element has an end that is movable in response to the temperature of the fresh food compartment. The end of the temperature responsive element is movable between a first position at which the end is spaced from the pathway of the cover plate and a second position at which the end is in the pathway of the cover plate. The end of the temperature responsive element is at the first position in response to the temperature of the fresh food compartment being less than a preselected value and at the second position in response to the temperature of the fresh food compartment being greater than the preselected value.

DETAILED DESCRIPTION OF THE INVENTION

Figure 1:
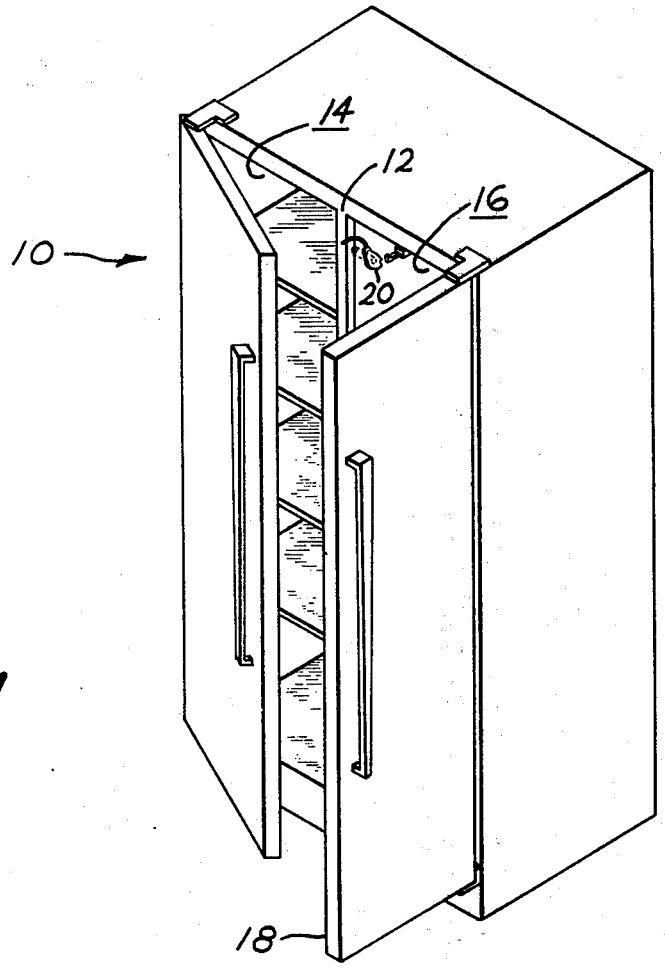
FIG. 1 is a perspective view of a household refrigerator-freezer having the apparatus of this invention.

In the embodiment of FIG. 1, a refrigerator-freezer 10 has a partition 12 separating a freezer compartment 14 from a fresh food compartment 16. The fresh food compartment 16 has an access door 18, as is known in the art.

Figure 2:
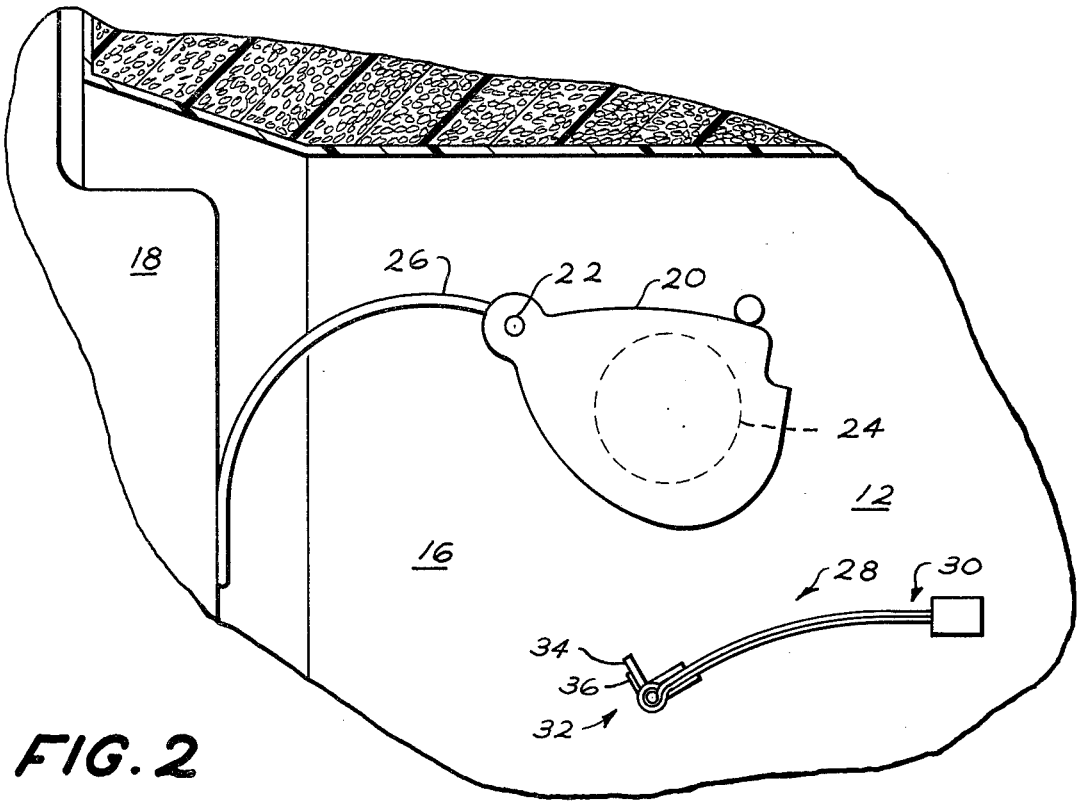
FIG. 2 is a diagrammatic partially sectioned view of the apparatus of this invention with the cover plate at the closed position.
Figure 3:
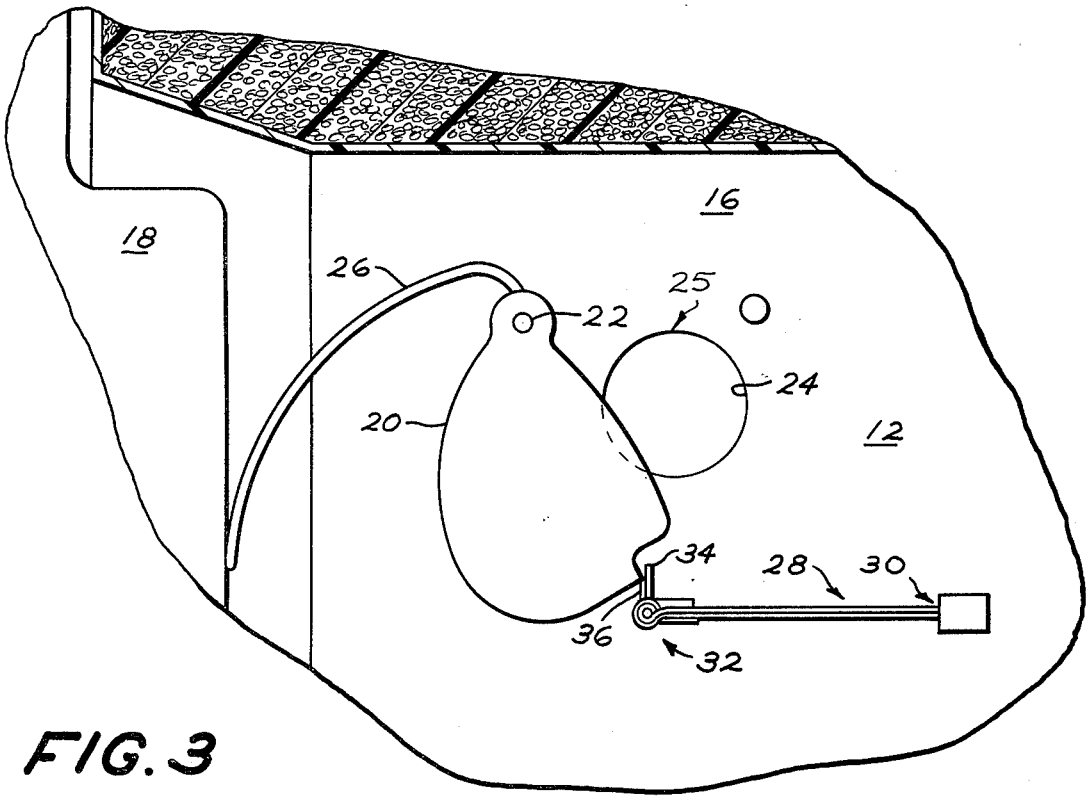

Referring to FIGS. 2 and 3, a cover plate 20 is pivotally connected by pin 22 to the partition 12 at a location within the fresh food compartment 16. The cover plate 20 is pivotally movable between a closed position (FIG. 2) at which the cover plate 20 is covering an air passageway 24 extending through the partition 12 and an open position (FIG. 3) at which the cover plate is spaced from at least a portion of the outlet 25 of the air passageway 24. The air passageway 24 provides for chilled air to pass by convection from the freezer compartment 14, through the partition 12 and into the fresh food compartment 16.

The cover plate 20 is pivotally connected to the partition 12 by a pin 22 at a location on the cover plate 20 at which the mass of the cover plate 20 biases the cover plate 20 to the open position in response to opening the refrigerator door 18. A biasing means 26, such as a deflectable arm for example, is connected to the cover plate 20 and extends toward the door 18. The biasing means 26 is of dimensions sufficient for contacting the door 18 and biasing the cover plate 20 toward the closed position in response to closing the door 18.

The temperature responsive element 28 has first and second ends 30, 32 and is positioned within the fresh food compartment 16 at a location adjacent the cover plate 20. The first end 30 is fixedly connected to the partition 12 or other structure of the refrigerator. The second end 32 is movable in response to the temperature of the fresh food compartment 16. The second end 32 is movable between a first position (FIG. 2) at which the end 32 is spaced from the pathway of the cover plate 20 and a second position (FIG. 3) at which the end 32 is in the pathway of the cover plate for contacting and controllably maintaining the cover plate 20 at the open position. The holding element end 32 is at the first position in response to the temperature of the fresh food compartment 16 being less than a preselected value and at the second position in response to the temperature of the fresh food compartment 16 being greater than a preselected value.

The temperature of the fresh food compartment 16 is generally maintained in the range of about 1°C to about 9°C. However, in some uses of the refrigerator-freezer, the temperature of the fresh food compartment may be maintained at a temperature as high as 16°C.

The properties of the temperature responsive element 28 can be finalized after the preselected temperature value has been selected. The temperature responsive element 28 can be a bimetallic element formed of copper and steel, for example. Such bimetallic temperature responsive elements 28 are well known in the art and can be easily constructed with different cooperating metals and different dimensions to provide elements 28 which will function, as set forth above, at a multiplicity of different preselected temperature values.

In the construction of the temperature responsive element 28, it should be understood that the chilled air passing through the passageway outlet 25 may flow over the element 28 and cause the element 28 to become colder than the temperature of the fresh food compartment 16. This differential temperature can be as great as several degrees centigrade. One can easily provide for this temperature biasing effect by making temperature measurements at the location of the element 28 and adjusting the preselected temperature value for obtaining data upon which to construct the element 28.

Figure 4:
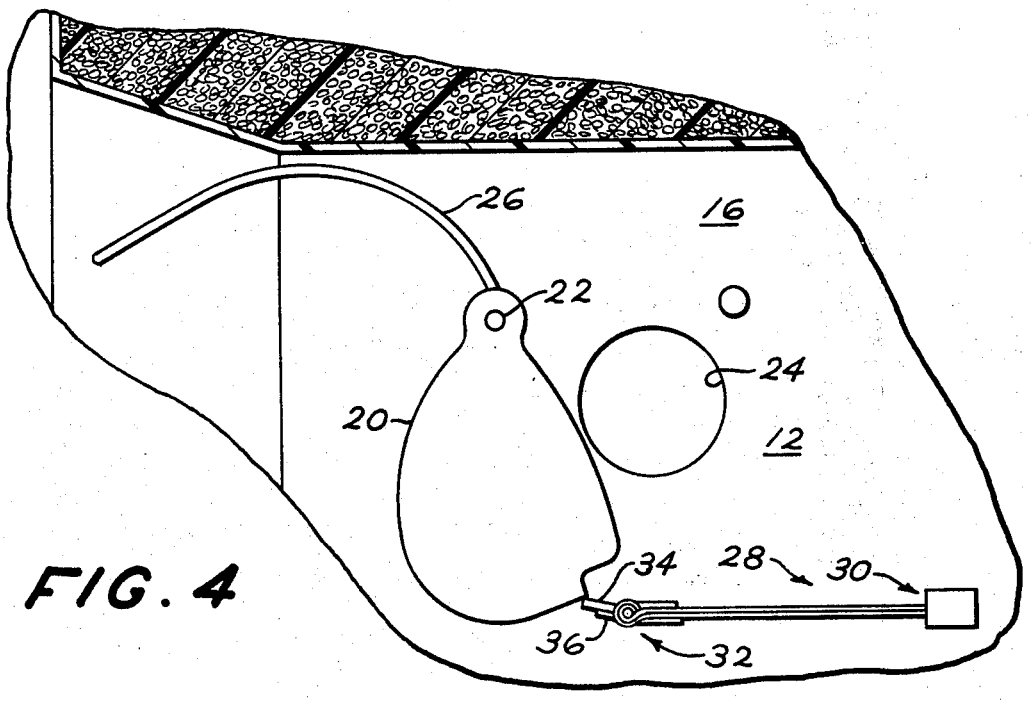
FIG. 3 is a diagrammatic partially sectioned view of the apparatus of this invention with the cover plate being maintained at the open position by the temperature responsive element and FIG. 4 is a partially sectioned view of the apparatus of this invention with the cover plate at a median location on the pathway of the cover plate moving from the closed toward the open position.

Referring to FIGS. 3 and 4, a contacting element 34 is pivotally connected to the second end 32 of the holding element 28 for increasing the smoothness of operation of the apparatus. The contacting element 34 is movable between first and second positions and is biased toward the first position by a spring 36.

The temperature responsive element 28, at the second position, is contacted by the cover plate 20 as the cover plate 20 moves from the closed toward the open position. This contact during movement of the cover plate 20 causes the contacting element 34 to move from the first position (FIG. 3) to the second position (FIG. 4). This pivotal movement of the contacting element 34 reduces the forces required to move the cover plate 20 past the holding element 28 when the holding element 28 and the cover plate 20 are in frictional contact with one another. After the cover plate 20 moves past the contacting element 34, the spring 36 moves the contacting element 34 to the first position in the pathway of the cover plate 20.

In the operation of the apparatus of this invention, the cover plate 20 moves from the closed position (FIG. 2) to the open position (FIG. 3) each time the door 18 is opened. At the open position of the cover plate 20, chilled air moves by convection from the freezing compartment 14, through the air passageway 24, and into the fresh food compartment 16. During closing of the door 18, the biasing means 26 contacts the door 18 and the cover plate 20 is urged toward the closed position.

If the temperature of the fresh food compartment 16 is less than the preselected temperature value, the element end 32 is at the spaced, first position (FIG. 2) and the air passageway 24 is closed by the cover plate 20 in response to forces placed on the biasing means 26 by the closing of door 18.

If, however, the temperature of the fresh food compartment 16 is greater than the preselected temperature value, the element end 32 is at the second position in the pathway of the cover plate 20, as shown in FIG. 3. As the door 18 closes and the cover plate 20 is urged toward the closed position by the biasing means 26, said cover plate 20 contacts the element end 32 which in turn prevents the cover plate 20 from covering the outlet 25 of the air passageway 24. At this position, the door 18 is closed and chilled air continues to move by convection into the fresh food compartment 16 for lowering the temperature of the fresh food compartment 16.

As the temperature of element 28 decreases, the element end 32 is moved from the second position (FIG. 3) toward the first position (FIG. 2). As the temperature of the fresh food compartment 16 becomes less than the preselected temperature value, the temperature responsive element end 32 is moved to the first position at which the end 32 is free from contact with the cover plate 20 and the cover plate 20 is biased by the biasing means 26 to the closed position covering the outlet of the air passageway 24.

By so constructing the apparatus of this invention, chilled air is controllably passed by convection from the freezing compartment 14 into the fresh food compartment 16 in response to opening the fresh food compartment door 18. Additional chilled air is controllably passed by convection into the fresh food compartment 16 in response to the temperature within the fresh food compartment 16 being greater than a preselected value.

Other modifications and alterations of this invention will become apparent to those skilled in this art from the foregoing discussion, and it should be understood that this invention is not to be unduly limited thereto.

What is claimed is:

1. In a household refrigerator-freezer having a fresh food compartment, a fresh food compartment access door, a freezer compartment, and a partition separating the fresh food compartment from the freezer compartment, the improvement comprising:

an air passageway having an inlet and an outlet, said passageway extending through the partition for the passage of air from the freezer compartment into the fresh food compartment;

a cover plate pivotally connected to the partition and being movable between a closed position at which the cover plate is covering the air passageway and an open position at which the cover plate is spaced from at least a portion of the air passageway outlet, said cover plate being biased to the open position in response to opening the door;

means biasing the cover plate toward the closed position in response to closing the door; and a temperature responsive element having an end movable in response to the temperature of the fresh food compartment, said end being movable between a first position at which the end is spaced from the pathway of the cover plate in response to the temperature of the fresh food compartment being less than a preselected value and a second position at which the end is in the pathway of the cover plate in response to the temperature of the fresh food compartment being greater than the preselected value for contacting and controllably maintaining the cover plate at the open position.

2. Apparatus, as set forth in claim 1, wherein the means is a deflectable arm connected to the cover plate and extending into forcible contact with the door at its closed position.

3. Apparatus, as set forth in claim 1, including a contacting element connected to the movable end of the temperature responsive element.

4. Apparatus, as set forth in claim 3, wherein the contacting element is pivotally connected to the holding element end for movement between first and second positions.

5. Apparatus, as set forth in claim 1, wherein the preselected temperature value is in the range of about +1°C to about +16°C.

* * * * *